United States Patent [19]

Ting

[11] Patent Number: 4,873,805

[45] Date of Patent: Oct. 17, 1989

[54] CONNECTING MEANS OF CURTAINWALL SUPPORTING MULLIONS

[76] Inventor: Raymond M. L. Ting, 318 Holiday Dr., Pittsburgh, Pa. 15237

[21] Appl. No.: 222,564

[22] Filed: Jul. 21, 1988

[51] Int. Cl.[4] ..... E04B 2/88

[52] U.S. Cl. ..... 52/235; 52/483

[58] Field of Search ..... 52/235, 395, 573, 713, 52/480, 481, 483, 487

[56] References Cited

U.S. PATENT DOCUMENTS 1,350,349 8/1920 Walther ..... 52/480

1,610,578 12/1926 Murphy ..... 52/480

2,944,641 7/1960 Peterson ..... 52/573

2,949,981 8/1960 Ferrell ..... 52/573

*Primary Examiner*—James L. Ridgill, Jr.

*Attorney, Agent, or Firm*—William J. Ruano

[57] ABSTRACT

The vertically slidable connection mean for the erection of curtainwall mullion is assembled from a housing clip, a holding clip and two side fastening clips to provide easiness in depthwise, lateral, and rotational adjustments during erection. At the location of supporting the dead weight of curtainwall, a load bearing member is preinstalled below the regular slidable connection mean, thus a unified erection procedure for all connection points is maintained.

6 Claims, 6 Drawing Sheets

CONNECTING MEANS OF CURTAINWALL SUPPORTING MULLIONS

BACKGROUND OF THE INVENTION

1. Field of the Invention

This invention relates to the exterior curtainwall construction. The curtainwall system is supported on spaced apart vertical mullions. The vertical mullions are structurally secured to the building at the edges of floor and roof slabs or spandrel beams. This invention is related to the connection means of the vertical mullions.

2. Description of the Prior Art

A curtainwall system is an exterior wall system installed outboard of the building perimeter frame to provide protections against the exterior weather conditions. The exterior wall system is normally supported on spaced apart vertical mullions. The vertical mullions are structurally connected to the building perimeter frame to provide the following two structural functions. The first structural function is to support the dead weight of the exterior wall system. The second structural function is to resist the inward or outward horizontal reaction forces transmitted from the exterior wall system due to wind loads. The available locations for connecting the mullions to the building are located along the edges of the roof and floor slabs. Aside from the wind load resisting requirement, the functional requirements of the exterior wall system include watertight performance and maintaining a certain degree of air tightness for the consideration of thermal efficiency. To maintain these functional requirements, the relative movements of the exterior wall joints must be minimized to be within the design tolerance. Since the mullions are structurally connected to the building along the edges of the floor and roof slabs, the effect of the relative deflection along the edges of the slabs between floors due to the variable live loads must be considered. Normally the floor slab is designed for a maximum allowable deflection of 1/360 of the span. For a commonly used span of 30 feet (9.14 m), the allowable maximum deflection is one inch (25.4 mm). This amount of deflection will become the relative movement between the floors if one of the floor is fully loaded and the other floor is empty. If this amount of relative movement is transmitted into the exterior wall system, the exterior wall joint can hardly be designed to accomodate the movement while maintaining the functional requirements. Therefore, it is commonly required that the connection means of the vertical mullions must be free from the effect of slab deflection.

There are three known methods for dealing with the floor deflection problem. The first method is to fasten the mullions to an independent horizontal truss spanning between building perimeter columns. Of course, this method is very expensive and thus it is seldomly used. The second method is to hang the mullions on relatively rigid roof spandrel trusses or beams and to provide vertically slidable connections at the floor levels. However, this method makes the mullion butt joint design difficult and expensive and thus it is seldomly used on buldings of more than two story high. The third method is to vertically support the mullion at the base floor level which is commonly a rigid bearing wall structure and to provide vertically slidable connections at the roof and the other floor levels. The third method is most popular in the curtainwall construction. The vertically slidable connection mean of the prior art design normally uses two spaced apart structural angle clips allowing the mullion to go in between the two confronting legs of the structural angles. The structural angle clips are structurally connected to the edge of the slab or the spandrel beam. The clips and the mullion are fastened together using structural bolts penetrating through the mullion and the protruding legs of the clips where vertically elongated bolt holes are provided in the angle clips. The working principle is explained as follows. When the slab undergoes deflection, the clips which are rigidly connected to the slab will slide downwardly relative to the mullion within the elongated hole without forcing the mullion downwardly. The angle clips are normally installed by welding before the installation of the mullion. The following practical considerations must be given in the execution of the vertically slidable connection design.

(1). In providing the gap between the two clips, the following tolerances must be considered. For the clips, they include the locational tolerance, the out of plumb tolerance among different floor levels, and the rotational tolerance of each individual clip. For the mullion, it is the side bow tolerance. Adding all the above tolerances together, it is normally required to design the gap to be about one inch (25.4 mm) wider than the width of the mullion.

(2). In providing the location of the bolt hole in the clips, the out of plumb tolerance among the slab edges of all floors must be considered. This tolerance normally requires about one inch (25.4 mm) inward and outward adjustability of the mullion location. This inward and outward adjustability can be referred to as the depthwise adjustability. Due to this tolerance requirement, the bolt holes through the mullion must be drilled in the field.

The drawbacks of the prior art slidable connection means are itemized as follows.

(1). The slidability of the elongated bolt hole may be impaired by over tightening of the bolt or rust binding. It is extremely difficult to provide a field guidence as to the proper tightness requirement for the connection bolt.

(2). Before the mullin is bolted in place, the mullion is floating in the air within the oversized gap between the clips. Since there is no inward or outward adjustability once the bolt holes on the mullion have been drilled, the final plumbing of the outer face of the mullion must be done before drilling the bolt holes. To secure the mullion in position for the bolt hole drilling is difficult involving temperary shimming operation. The shimming operation or the vibration during hole drilling may throw the mulliom out of plumb again, therefore, a tedious procedure of checking and rechecking is normally encountered.

(3). To plumb the side face of the mullion, shims on both sides between the mullion and the clips must be used. However, the difference in the thickness of the shim between the two sides affects the horizontal distance between the mullions. Therefore, the side face plumbing and the adjustment of the horizontal distance must be executed concurrently. This requires at least a three-man crew in performing the task.

(4). Theoretically the location of the bolt hole in the mullion at the floor level should be located at the bottom of the elongated hole during erection to allow for free downward movement of slab due to live loads. However, some upward movement is possible due to floor vibration or thermal differential between the erection condition and the service condition, therefore, the bolt hole should be located slightly above the bottom of the elongated hole. Significant upward movements exist at the roof level due to the uplifting wind forces. Therefore, at the roof level, the bolt hole in the mullion should be located in the middle region of the elongated hole on the clips. Field error is very likely due to the different locational requirements.

(5). In a utilized erection where preassembled wall segment on multiple mullions is lifted into place and then connected to the clips. Due to the sealing requirement along the vertical joint between two wall segments, it normally requires a parallel horizontal movement to engage and to form a sealed vertical joint. To accomodate this lateral side engagement motion, it would require a wide gap between the two clips making the design for the connection strength difficult if not impossible due to bending on the bolt. To install the clip on the engaging side after the engagement of of each wall segment is cost prohibitive due to the requirement of performing welding on all floor levels after the engagement of each wall segment. In addition, sparks during welding may damage the finishes of the preassembled wall segment. In the prior art system utilizing unitized erection procedure, much more elaborated connection system including prewelded horizontal seating clip on the building frame and preassembled slidable connection assemblies on the mullions of each wall segment. Upon the engagement of the wall segment, the connection assemblies on the mullions are then bolted to the seating clips on the building frame. The clip design to allow positioning and rotational adjustments is always expensive and difficult to execute in the field.

SUMMARY OF THE INVENTION

The objective of this invention is to provide an economical and versatile mullion connection system eliminating the drawbacks of the prior art systems. The connection system of this invention includes three components, namely, a housing clip, a holding clip, and two side fastening clips. The housing clip is firmly secured to the building perimeter along the edge of slab or spandrel beam. The housing clip is initially loosely housed in the housing clip to provide the depthwise, the lateral, and the rotational adjustabilities. The holding clip is finally secured in position by providing shims as required within the housing clip. The two fastening clips have one edge profiled to cause structural engagement with the holding clip in a vertically slidable fashion so that the inward and the outward relative movements between the holding clip and the fastening clip are completely restrained while the vertical relative movement is not restrained. The working mechanism of the invention will become apparent from the description of the preferred embodiments.

DESCRIPTION OF THE PREFERRED EMBODIMENTS

Figure 1:
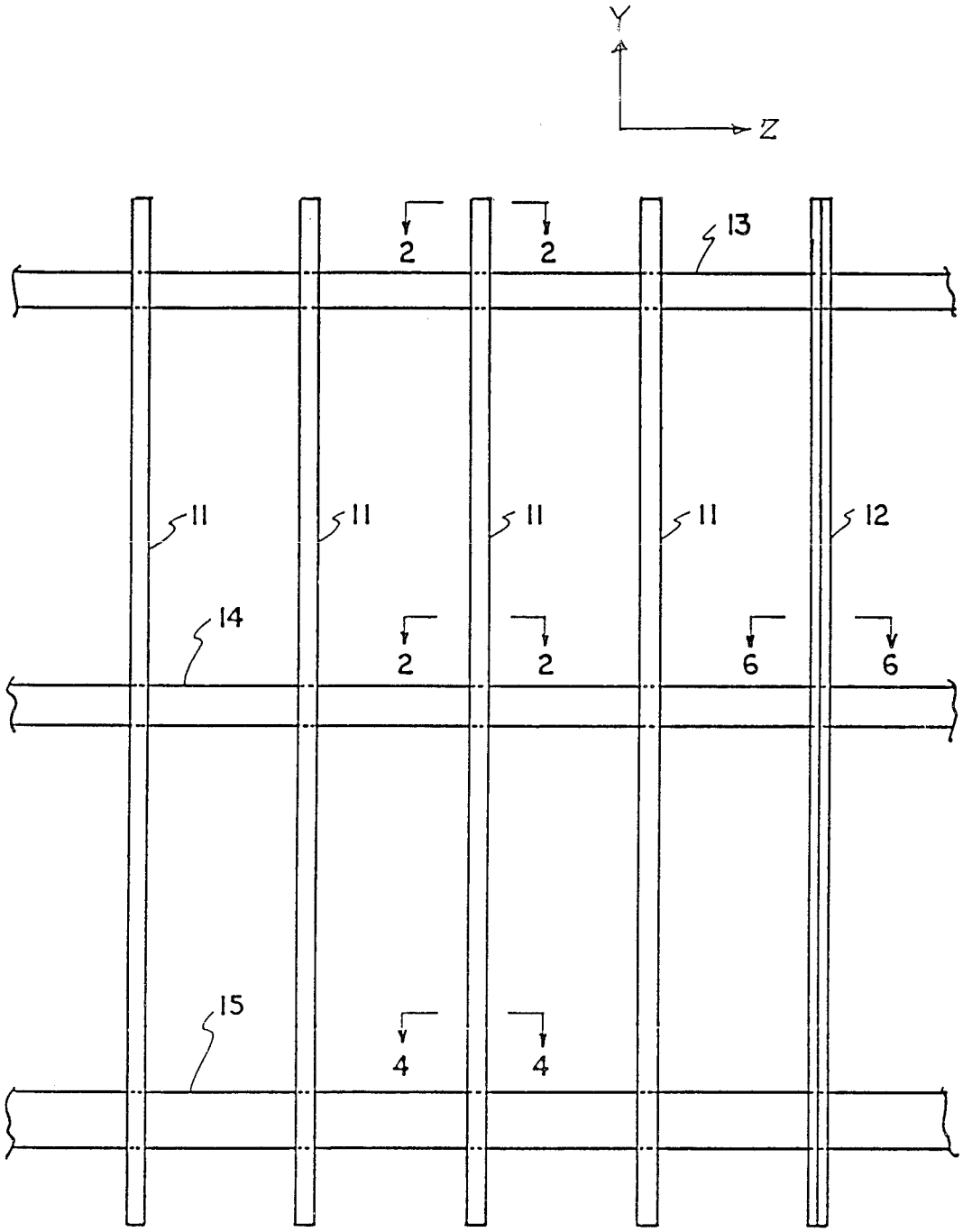
FIG. 1 shows a partial typical elevatoin of curtainwall supporting mullions covering a roof level, an intermediate floor level, and a base floor level.

FIG. 1 illustrates a partial typical curtainwall supporting structure consisting of spaced apart vertical mullions 11 and/or split mullion 12 secured to a roof slab 13, an intermediate floor slab 14, and a wall base floor slab 15.

Figure 2:
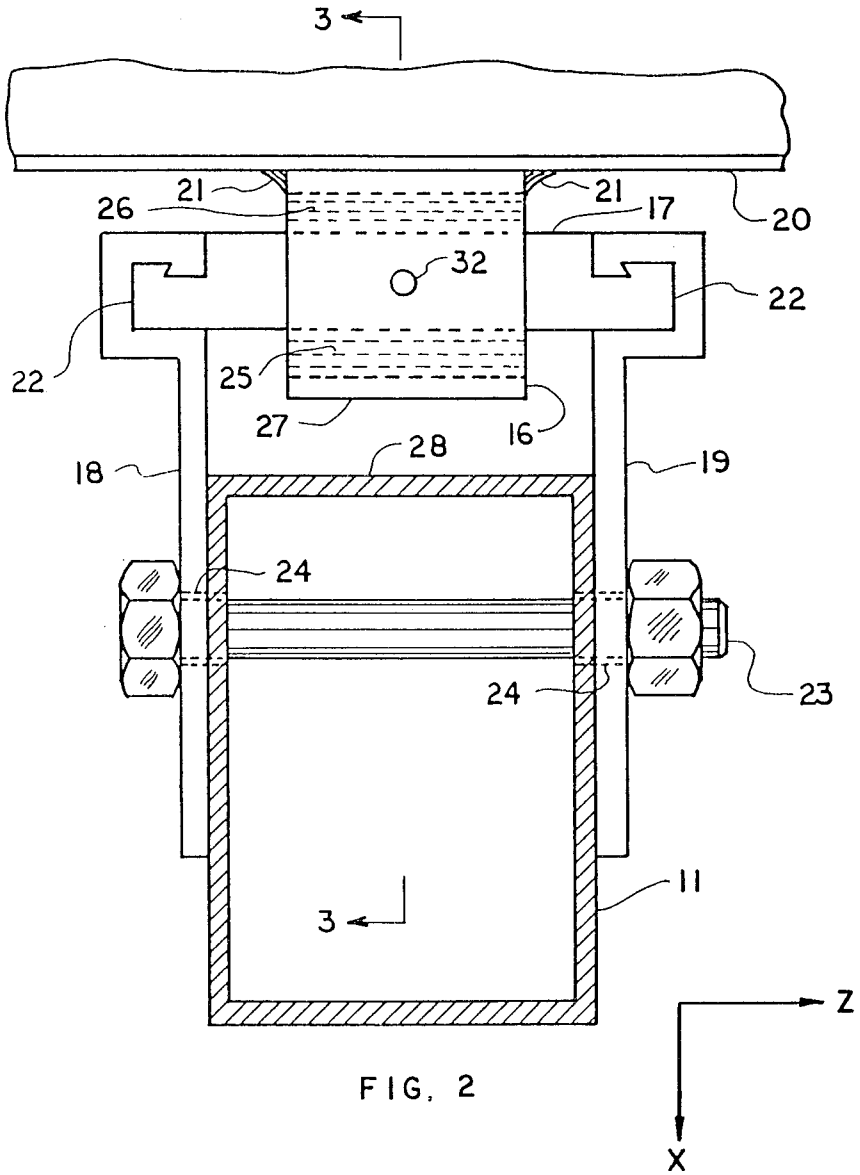
FIG. 2 is a typical fragmentary cross-sectional view taken along line 2—2 of FIG. 1 showing the vertically slidable mullion connection system of this invention.

FIG. 2 is a typical fragmentary cross-sectional view taken along line 2—2 of FIG. 1 showing the vertically slidable mullion connection system of this invention. The connection system includes a housing clip 16, a holding clip 17, and two side fastening clips 18 and 19. The housing clip 16 is firmly secured to the slab edge plate 20 by side welds 21. The installed housing clip 16 provides a horizontal hollow cavity to allow the installation of the holding clip 17 through the horizontal hollow cavity. The side fastening clips 18 and 19 are structurally connected to the holding clip 17 by a vertically slidable matching profile 22. The vertical mullion 11 is bolted to the side fastening clips 18 and 19 using bolts 23. The erection procedures are described as follows. The housing clips 16 are pre-installed along the building perimeters. Each individual mullion 11 is then lifted into position. The holding clip 17 is then inserted through the hollow cavity of the housing clip 16. The side fastening clips 18 and 19 are then slid vertically into engagement with the holding clip 17 to sandwich the mullion 11 in between. Clamp the side fastening clips 18 and 19 together with the mullion 11 and drill the fastening holes 24 and apply bolt 23. To plumb the exterior face of the mullion 11, install the front shim 25 and the back shim 26 as required within the horizontal hollow cavity of the assembled housing clip 16. The depthwise adjustability is provided by the difference between the width of the hollow cavity and the thickness of the holding clip 17 as well as the clearance between the front element 27 of the housing clip 16 and the back flange 28 of the mullion 11. To plumb the side face of the mullion 11 and to place the mullion in the correct lateral position, simply tap assembled clips 17, 18, 19 together with the mullen 11 to the left or to the right as required. The difference between the width of the mullion 11 and the width of the housing clip 16 provides the lateral adjustability. This lateral adjustability does not require any gap between the fastening clip 18 or 19 and the side face of the mullion 11, therefore, the gap between the fastening clips 18 and 19 can be designed to be tightly fitted with the mullion 11 facilitating the easiness of field drilling the fastening holes 24. It is apparent that the assembled connection system can absorb either upward or downward vertical relative movements between the holding clip 17 and the side fastening clip 18 or 19 due to the slidable engagment profile 22 and is independent of the tightness of the bolts. It is also clear that relative vertical movement are accommodated without the use of elongated clip holes eliminating the field confusion of bolt hole location in the prior art systems. The particular slidable engagment profile 22 as shown is for illustrative purpose only. Many other vertically slidable engagement profiles can be contemplated. From the above assembling sequences, it becomes apparent that the plumbing of the exterior mullion face and that of the mullion side face are executed independently after the mullion 11 has been bolted, therefore, the difficulty of plumbing a mullion floating in the air of the prior art systems is eliminated and thus, the quality of the plumb will be significantly improved over the prior art systems. After the lateral positioning has been done, a securing pin 32 can be installed to lock the holding clip 17 to the housing clip 16 preventing the holding clip from lateral walking. The welded connection between the housing clip 16 and the slab perimeter plate 20 as shown is for illustrative purpose only. Many other connecting means can be contemplated. Due to the tight fitting between the mullion 11 and the clips 18 and 19, metal screws may be used to replace the bolts 23.

Figure 3:
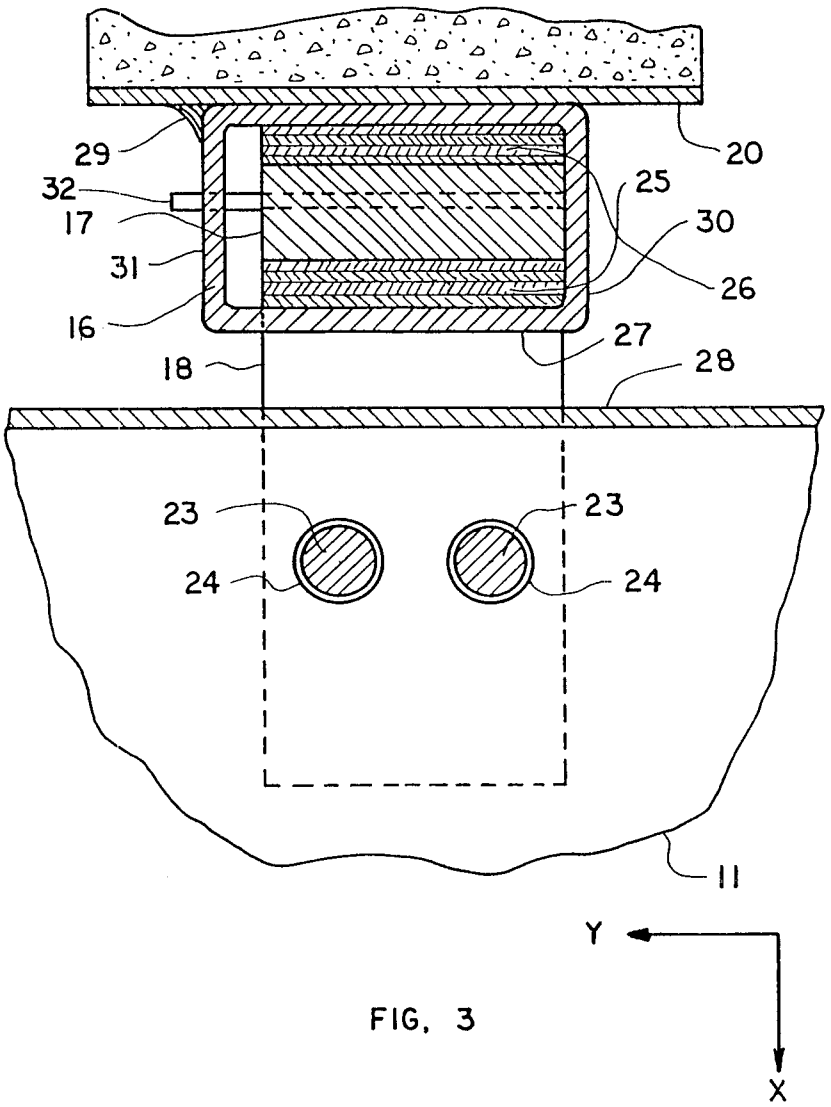
FIG. 3 is a typical fragmentary cross-sectional view taken along line 3—3 of FIG. 2.

FIG. 3 is a typical fragmentary cross-sectional view taken along line 3—3 of FIG. 2. In addition to the side welds 21 shown in FIG. 2, the housing clip is secured to the slab edge plate 20 by the top weld 29. The holding clip 17 is secured in position within the horizontal hollow cavity of the assembled housing clip 16 by the front shim 25 and the back shim 26. The fastening clip 18 is engaged with the holding clip 17 as shown in FIG. 2 and is connected with the mullion 11 using bolts 23 through the fastening hloes 24. The holding clip 17 and the shims 25 and 26 are confined within the housing clip 16 and supported by the bottom flange 30 of the housing clip 16 preventing them from falling out. It can be seen that the vertical movement of the holding clip 17 is restrained within the distance between the bottom flange 30 and the top flange 31 of the housing clip 16 and the inward and the outward movements of the holding clip 17 is completely restrained by the shims 25 and 26. The height of the holding clip 17 is preferred to be slightly less than the clear distance between the flanges 30 and 31 as shown to allow rotational adjustability of the holding clip 17. The front shim 25 may be eliminated if front face plumbing of the mullion 11 is done with the holding clip 17 being in contact with the front element 27 of the housing clip 16 before drilling the fastening holes 24.

Figure 4:
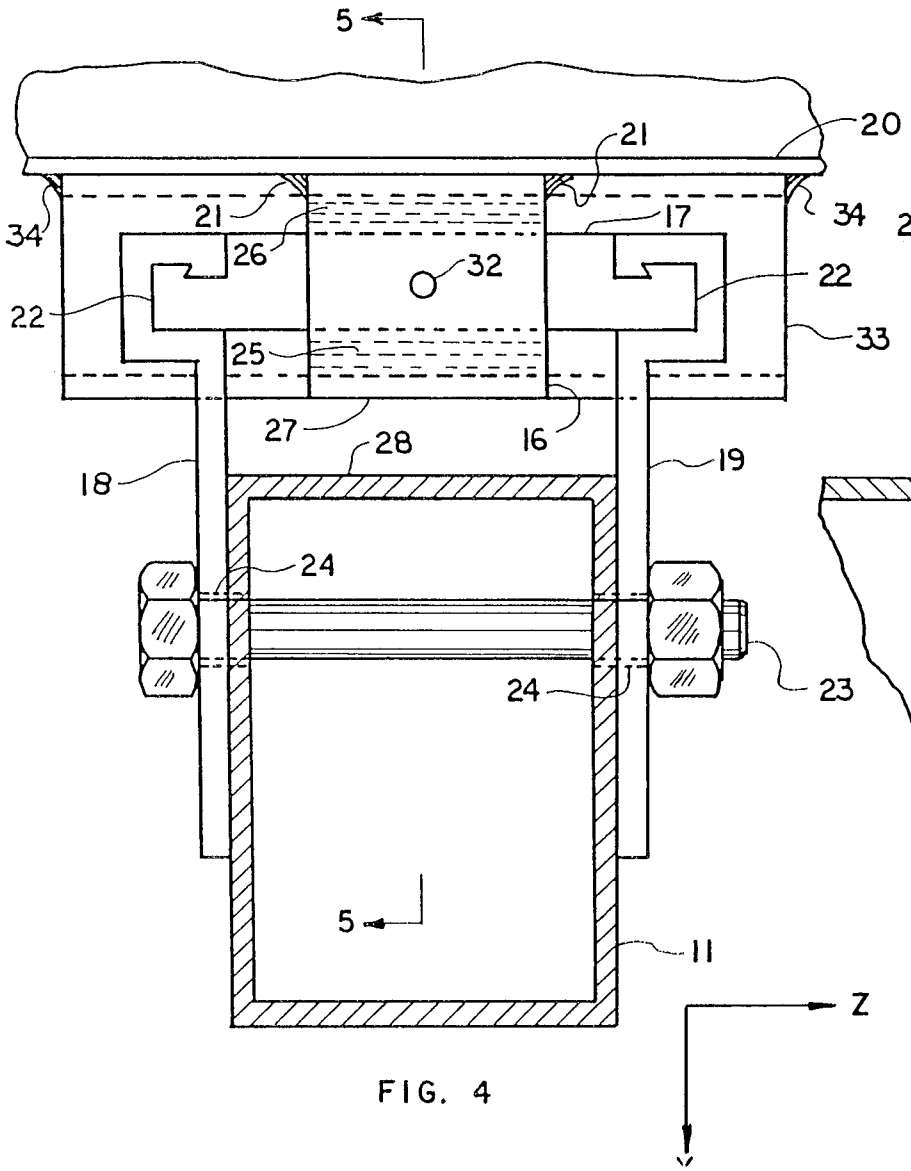
FIG. 4 is a typical fragmentary cross-sectional view taken along line 4—4 of FIG. 1 showing the arrangement of the vertically supported point of the mullion at the base floor level.

FIG. 4 is a typical fragmentary cross-sectional view taken along line 4—4 of FIG. 1 where vertical support for the dead weight of the curtainwall is provided. A load bearing member 33 is preinstalled below the housing clip 16 and connected to the slab edge plate 20 by welds 34. The load bearing member 33 is extended laterally beyond the housing clip 16 to allow the side fastening clips 18 and 19 to seat on top of the load bearing member 33. In this arrangement, the dead weight of the curtainwall is transmitted to the load bearing member 33 through the side fastening clips 18 and 19. The other assembling procedures are the same as explained in FIG. 2. For a highrise building, several load bearing points along the height of the building may be necessary to segment the wall weight to prevent overloading. In this case, it is preferred to provide spandrel trusses independent of the floor slab at the levels of the load bearing points so that the load bearing function will not be affected by the relative floor deflections. It must be noted that any prior art load bearing connection system can be used at the load bearing level in conjunction with the vertically slidable connection system of this invention at the other levels. However, it is preferred to use the system described in FIG. 4 since the assembling procedures are the same as those at the slidable connection levels.

Figure 5:
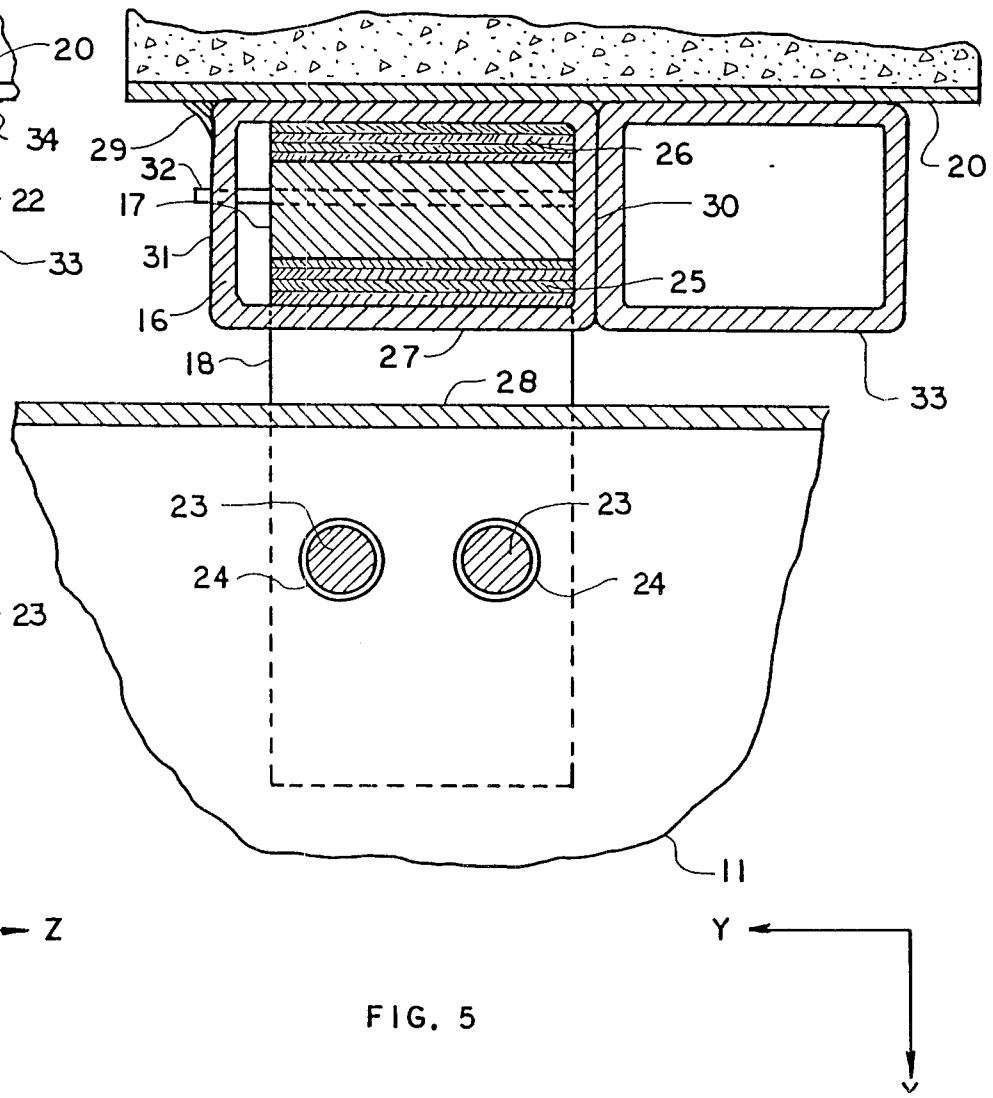
FIG. 5 is a typical fragmentary cross-sectional view taken along line 5—5 of FIG. 4.

FIG. 5 is a typical fragmentary cross-sectional view taken along line 5—5 of FIG. 4. As shown, the load bearing member 33 is of a tubular profile. Many other profiles having a top bearing surface are applicable for use as the loading bearing member 33. The other features are the same as explained in FIG. 3.

Figure 6:
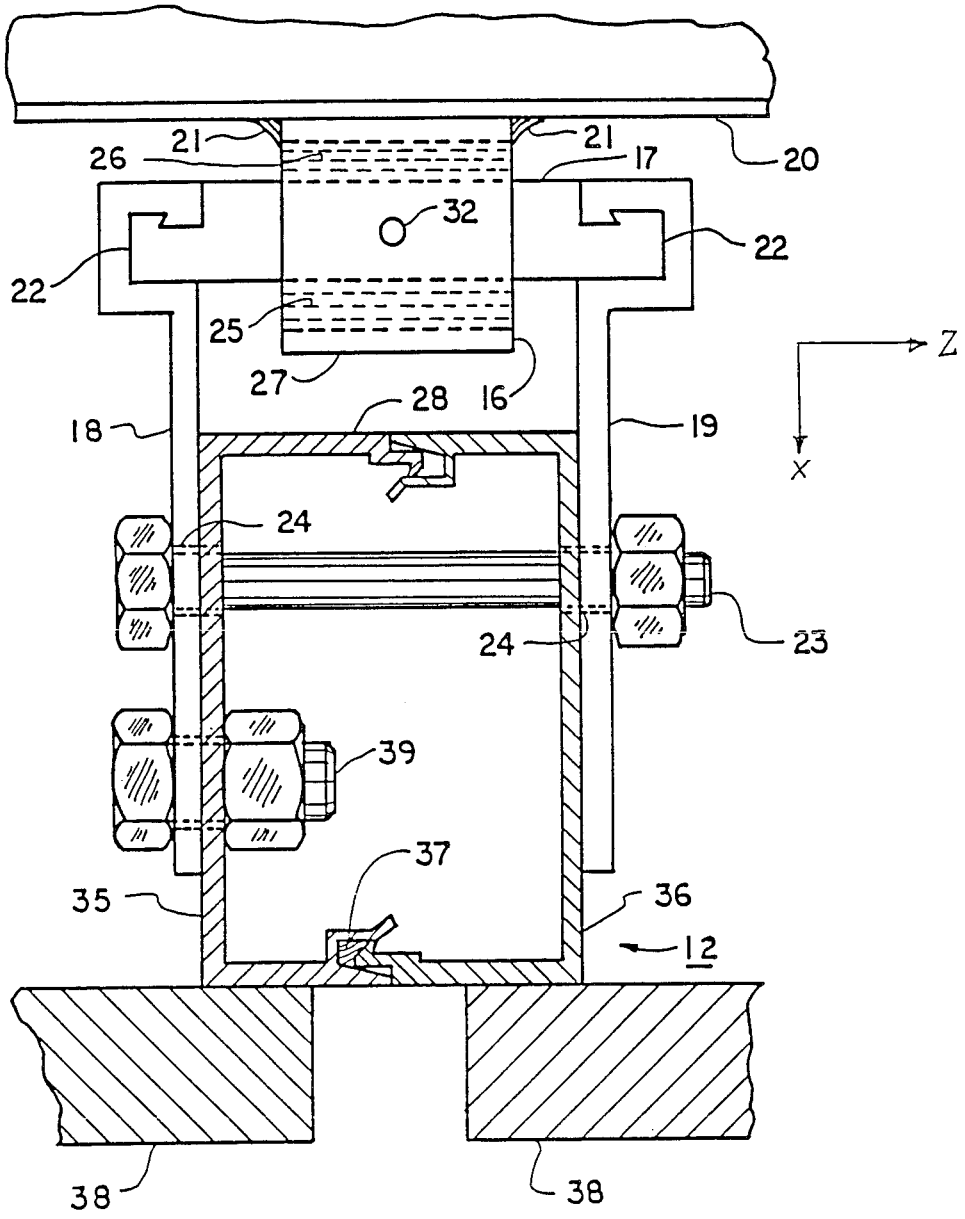
FIG. 6 is a typical fragmentary cross-sectional view taken along line 6—6 of FIG. 1 showing the connection system of this invention utilized in the unitized erection procedure using a split edge mullion.

FIG. 6 is a typical fragmentary cross-sectional view taken along line 6—6 of FIG. 1 where split mullion 12 is utilized in the unitized erection procedure. The split mullion 12 consists of a left half 35 and a right half 36 inter-locked and sealed with sealant 37. Each of the half mullion has preassembled wall panels 38. For a left-to-right erection procedure, the preassembled wall segment containing the left half mullion 35 is lifted into position using the plumbing and locating procedures as explained in FIG. 2 and FIG. 3 except that it is temporarily fastened with the short bolts 39 at all fastening points. Then, the preassembled wall segment containing the right half mullion 36 is lifted into position. At this stage, the right fastening clip 19 has not been installed, therefore side engagement of the right half mullion 36 with the left half mullion 35 can be easily done without interference. The right fastening clip 19 is installed after mullion engagement and the permanent bolts 23 are then installed. The advantages of unitized erection are realized without being offset by the disadvantages of elaborated connecting systems of the prior art designs.

Figure 7:
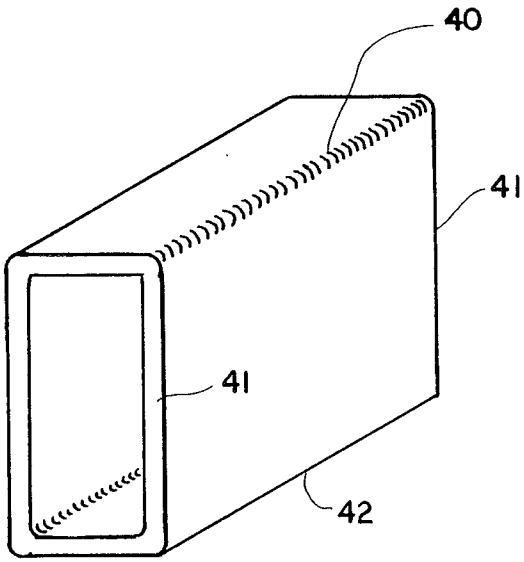
FIG. 7 is an isometric view of a typical housing clip of this invention having a tubular profile.

FIG. 7 is an isometric view of a typical housing clip having a tubular profile. The clip can be welded to the slab edge plate 20 along the top contacting edge 40 and the side contacting edges 41. The over-head welding along the bottom contacting edge 42 can be eliminated.

Figure 8:
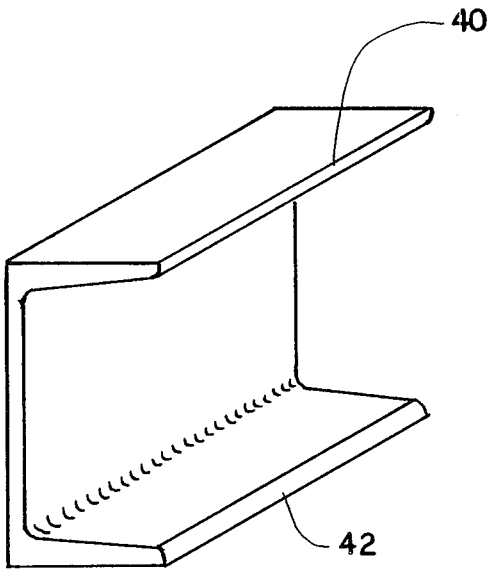
FIG. 8 is an isometric view of a typical housing clip of this invention having a channel profile.

FIG. 8 is an isometric view of a typical housing clip having a channel profile. The clip must be welded to the slab edge plate 20 along the top contacting edge 40 and the bottom contacting edge 42. Since the over-head welding along the bottom edge 42 is required, this clip profile is not preferred.

Figure 9:
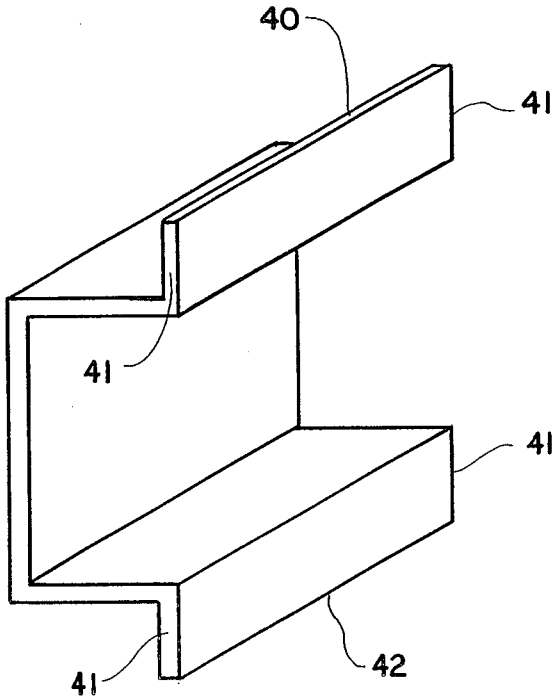
FIG. 9 is an isometric view of a typical housing clip of this invention having a hat-shaped profile.

FIG. 9 is an isometric view of a typical housing clip having a hat-shaped profile. The clip can be welded to the slab edge plate 20 along the top contacting edge 40 and the side contacting edges 41. The over-head welding along the bottom contacting edge 42 is not required.

Figure 10:
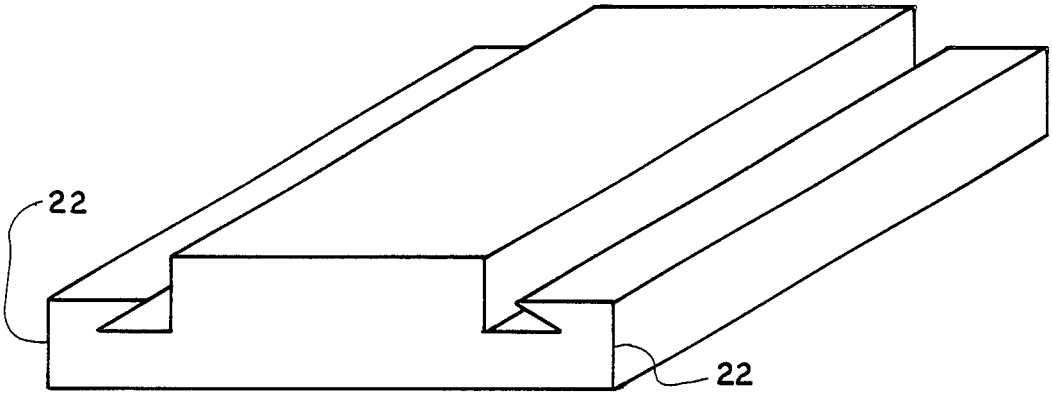
FIG. 10 is an isometric view of a typical holding clip of this invention.

FIG. 10 is an isometric view of a typical holding clip 17 of this invention. Each side edge is contoured with a male slidable inter-locking profile 22.

Figure 11:
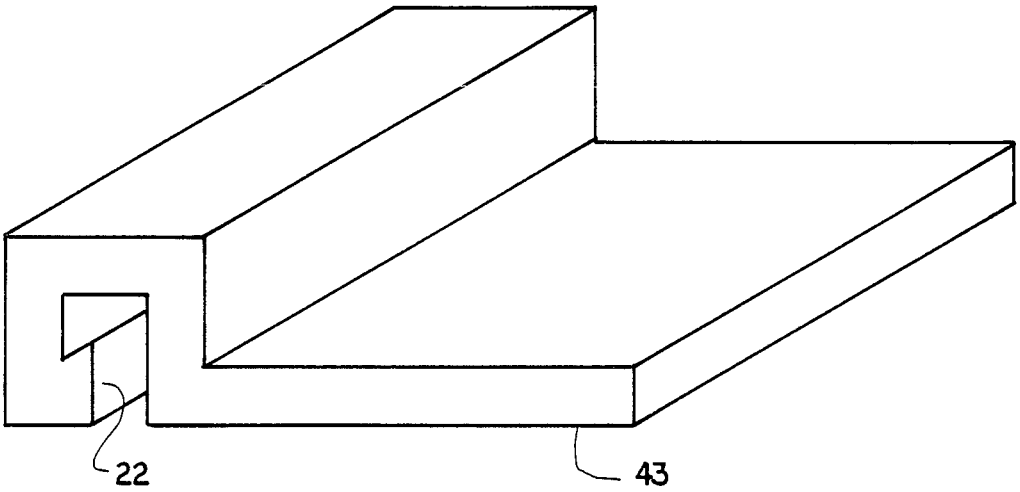
FIG. 11 is an isometric view of a typical side fastening clip of this invention.

FIG. 11 is an isometric view of a typical side fastening clip 18 or 19. The clip has an extended fastening flange 42 and an edge rib having a female slidable interlocking profile 22 which matches with the male slidable inter-locking profile 22 of FIG. 10.

Figure 12:
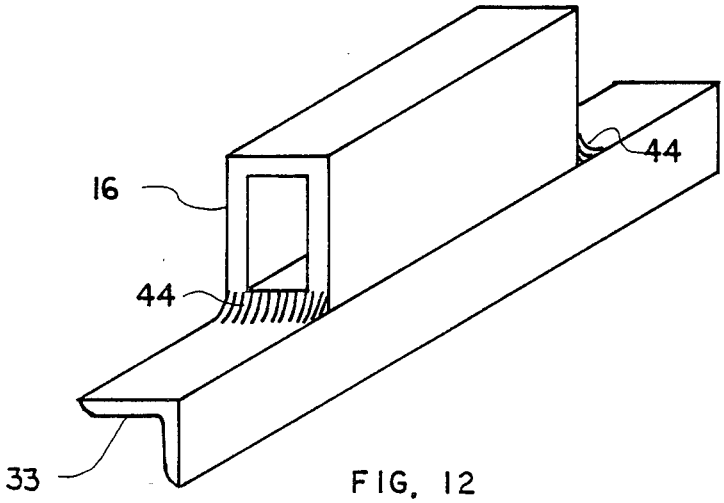
FIG. 12 is an isometric view of a typical housing clip with an integral load bearing member suitable for use at the mullion supporting point such as at the wall base.

FIG. 12 is an isometric view of a typical housing clip 16 with an integral load bearing member 33 of a structural angle shape for use at the dead weight supporting location. The housing clip 16 is welded to the load bearing member 33 by welds 44. Other structural shapes having a top bearing surface can be used for the load bearing member 33 such as the tubular shape shown in FIG. 5.

While I have illustrated and described several embodiments of my invention, it will be undersood that these are by way of illustration only and that various changes and modifications may be contemplated in my invention and within the scope of the following claims.

I claim:

1. A curtainwall structure forming an exterior wall surface defining a X-direction being horizontally perpendicular to said wall surface, a Y-direction being vertically parallel to said wall surface, and a Z-direction being horizontally parallel to said wall surface, said curtainwall structure being supported on at least two spaced apart mullions spanning in said Y-direction, each said mullion being connected to a building frame at at least two locations along said Y-direction using a first connection means and at least one second connection means, said first connection being fixed in both said X-direction and Y-direction, said second connection means being fixed in said X-direction and slidable in said Y-direction, the improvement of said second connection means comprising:

(a) a housing clip having at least one web integrally connecting with two spaced apart flanges;

(b) said housing clip being firmly fixed to said building frame in said X-direction, Y-direction, and Z-direction, forming a hollow space along said Z-direction, said hollow space being defined by a hollow depth in said X-direction, a hollow height in said Y-direction, and a hollow length in said Z-direction;

(c) a holding clip having a width in said Z-direction being larger than said hollow length, a length in said Y-direction being smaller than said hollow height, a depth in said X-direction being smaller than said hollow depth, and having an engaging profile slidable in said Y-direction and fixed in said X-direction and Z-direction along side edge parallel to said Y-direction;

(d) said holding clip being secured and fixed in said X-direction within said hollow space where said engaging profiles being positioned out of said hollow space;

(e) at least one fastening clip having a slidable engaging profile matched with said engaging profile of said holding clip and an integral fastening flange having a surface parallel to a plane defined by said X-direction and Y-direction;

(f) said mullion being firmly fastened to said fastening flange of said fastening clip slidably engaged along the edge of said holding clip.

2. The improvement of claim 1 wherein said first connection means comprising:

(a) a load bearing member having a load bearing surface along a plane defined by said X-direction and Z-direction, said load bearing surface having a width in said X-direciton larger than said hollow width and a length in said Z-direction larger than said width of said holding clip;

(b) together with said second connection means, said load bearing member being installed beneath said housing clip with said load bearing surface extended beyond the edges of said holding clip in both said X-direction and Z-direction and fixed in said X-direction, said Y-direction, and said Z-direction.

3. The improvement of claim 1 wherein said housing clip is of a tubular profile.

4. The improvement of claim 1 wherein said housing clip is of a hat-shaped profile.

5. The improvement of claim 1 wherein said mullion is a split mullion consisting of two inter-locking halves.

6. The improvement of claim 1 wherein said holding clip is fixed in said Z-direction by a fastener penetrating through said housing clip into said holding clip.

* * * * *